US005836374A

United States Patent [19]

Mai

[11] Patent Number: 5,836,374

[45] Date of Patent: Nov. 17, 1998

[54] CHILL PLATE AND STACKED MOLD

[75] Inventor: Sumitoshi Mai, Kashiwazaki, Japan

[73] Assignees: Kabushiki Kaisha Riken, Tokyo; Riken Castec Corporation, Kashiwazaki, both of Japan

[21] Appl. No.: 778,218

[22] Filed: Jan. 8, 1997

[30] Foreign Application Priority Data

Mar. 13, 1996 [JP] Japan ..... 8-083035

[51] Int. Cl.[6] ..... B22C 9/20; B22D 15/00

[52] U.S. Cl. ..... 164/322; 164/352; 164/371; 249/81

[58] Field of Search ..... 164/322, 323, 164/324, 352, 353, 354, 355, 356, 357, 371; 249/81

[56] References Cited

U.S. PATENT DOCUMENTS

| | | | |
|---|---|---|---|
| 3,659,997 | 5/1972 | Rees | 425/247 |
| 4,706,924 | 11/1987 | de Larosiere | 249/161 |
| 4,884,962 | 12/1989 | Sheffield | 425/234 |
| 5,072,773 | 12/1991 | Ruff et al. | 164/127 |
| 5,450,665 | 9/1995 | Madono et al. | 29/888.1 |
| 5,533,563 | 7/1996 | Lee, Sr. | 164/127 |

FOREIGN PATENT DOCUMENTS

| | | |
|---|---|---|
| 0 456 290 A2 | 11/1991 | European Pat. Off. . |
| 1 483 288 | 8/1977 | United Kingdom . |
| 2 275 636 | 9/1994 | United Kingdom . |
| 2 277 284 | 10/1994 | United Kingdom . |
| 2 307 197 | 5/1997 | United Kingdom . |

*Primary Examiner*—David W. Wu
*Attorney, Agent, or Firm*—Kubovcik & Kubovcik

[57] ABSTRACT

Chill plates are integrated into a cassette to save the time which has been required to rearrange chill plates scattered at the time of output of castings. Each chill plate 1 is formed, on four corners thereof, with cavities 4 and 7 each corresponding to a quarter of a member to be chilled and with a center hole 9 through which a fixed shaft 7 is inserted in the center thereof.

16 Claims, 4 Drawing Sheets

CHILL PLATE AND STACKED MOLD

BACKGROUND OF THE INVENTION

The present invention relates to chill plates and a stacked mold used for a mold structure in which chill plates are implanted in a mold or flask.

There is a wide range of application for composite cast iron materials having a chilled structure formed by using chill plates during casting process.

Cam shafts for internal combustion engines are a typical field of application of them. Actually, in Japan and Europe, the internal combustion engines more than 70% of medium and small internal combustion engines excluding those for large ships use the cam shafts made of the composite cast iron materials having the chilled structure formed only in a cam portion of the cam shaft by means of the casting process employing partially forced cooling and hardening steps. By chilling the entire circumference of the cam portion or forming a hollow shaft portion, the hardness of the chilled portion and the micro-structure can be further improved, which is expanding the application of such materials.

Systems for the chilled cam shafts currently produced in Japan and Europe are generally classified into (1) casting process using a green sand type high pressure mold which is obtained by mechanical ramming and (2) casting process using a mold which is hardened by using a chemical binder. In either case, a mold structure is employed in which chill plates are implanted in the mold to forcibly cool and harden the cam portions of the cam shaft concurrently with casting. In the United States, the cam shafts are hardened by quenching because such automated implantation of the chill plates in a casting system is not available.

The recent trend toward automobiles of higher performance has resulted in more complicated valve mechanisms, and this necessitates increasing the number of the cams disposed within a predetermined length of the cam shaft and making the surface of the increased number of the cams harder. For this reason, casting methods utilizing chill plates are attracting more attention.

Referring to casting process by implanting the chill plates in the mold, the green sand type high pressure casting process wherein water and green sand added with a binder are simply mechanically rammed has been found unsatisfactory in that it is limited in adaptability to product designs intended for an increased number of the cams and in that water included in green sand reacts with poured molten metal in contact with the chill plates resulting in accidental internal gas defects which increase in proportion as the number of the cams increases.

For the above reasons, casting process using the chemically hardened mold which easily accommodates to near net shapes and has high adaptability to product designs is more advantageous than casting process using the green sand type high pressure mold, although the latter provides a high productivity. Under such circumstances, most Japanese and European firms producing the chilled cam shafts employ casting based on a shell mold process or cold box process utilizing a chemically hardened mold, and only the limited number of firms employ casting using the green sand type high pressure mold for items in limited design shapes.

Chemically hardened molds for the chilled cam shafts for internal combustion engines of the automobiles are produced using the shell mold process wherein upper mold (cope frame) and lower mold (drag frame) are independently formed and are closed and bonded after manually implanting the chill plates. Gating systems used in this case include those to obtain horizontally poured and laterally arranged plural molds, vertically poured and laterally arranged multiple molds, vertically poured and longitudinally arranged plural molds, and vertically poured stack-cast laterally arranged multiple molds.

Rapid advances in the recent development of internal combustion engines have accelerated the trend toward multi-cam configurations, especially in lean burn engines. For example, in a single cam valve system for four-cylinder engines, one cylinder can have even five cams, which means the number of twenty cams for a single cam shaft. This necessitates chill plates to be implanted in a mold in a large quantity corresponding to such a quantity of cams. It has therefore become a must, in order to improve manufacturing efficiency of mass production items, to fully automate the installation and removal of the chill plates by shortening various conventional steps, i.e., collecting, separating and arranging the chill plates, attaching them to a magazine and implanting them in a mold.

As a possible solution to this, a plurality of the chill plates or laterally arranged groups of the chill plates in a quantity which is an integral multiple thereof are connected into an integral element. However, such chill plates connected into an integral element are deformed as a whole by high temperatures they are exposed to during the casting process. This leaves problems in formation of a mold and quality of products.

It is an object of the present invention to address the above-described problem or point to be improved.

SUMMARY OF THE INVENTION

The optimum way to automate the installation and removal of chill plates to solve the above-described problem is to provide a superimposed type mold with the chill plates which is formed by disposing the chill plates on a solid pattern of a metal mold and by filling the gap formed therebetween with foundry sand. The improvement is based on an understanding that the difficulty encountered in doing this originates in non-uniform configurations of upper and lower parts of a single chill plate where different profiles coexist and in the rigidity of a plurality of such chill plates themselves when integrated by connecting them into a plurality of lateral arrays.

Specifically, according to the present invention, there is provided a chill plate which is substantially the same in height as a mold and which comprises cavities each corresponding to a split part for a quarter of each of first members to be chilled laterally adjacent to each other, provided on the left and right sides of the an upper surface thereof, and comprises cavities each corresponding to a split part for a quarter of each of second members to be chilled located below the first members to be chilled and laterally adjacent to each other, provided on the left and right sides of a lower surface thereof.

With such a configuration of a chill plate, quarters of a profile corresponding to a product in the lateral arrays are provided on separate locations of a single chill plate to form the chill plate in a cross-like configuration. This allows the chill plates to be simplified and uniform, thereby preventing deformation of the same due to thermal shock. Further, where a no-chilled portion must be provided, an oversized profile similar to such a portion is formed to provide a gap in which foundry sand is filled.

According to the present invention, there is also provided a stacked mold comprising chill plates secured to vertically stacked end plates and arranged along horizontally and vertically arranged fixed shafts and collars or bosses integral with the chill plates located between the chill plates wherein the chill plates have play in a direction orthogonal to the fixed shafts.

DESCRIPTION OF PREFERRED EMBODIMENTS

Figure 1:
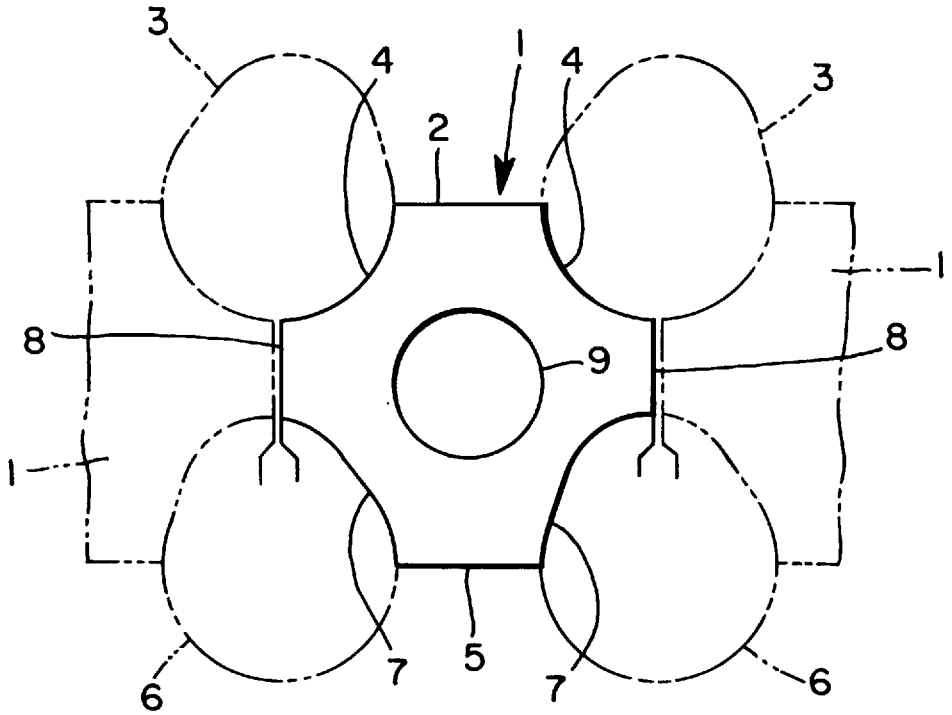
FIG. 1 is a front view of a chill plate according to a first embodiment of the present invention.

A chill plate 1 according to the present invention will now be described with reference to FIG. 1. The chill plate 1 is substantially the same in height as each of molds which are stacked. The chill plate 1 has, on the left and right sides of its upper surface 2, cavities 4 each corresponding to a split part for a quarter of each of first cam members 3 of cam shafts to be chilled laterally adjacent to each other and has, on the left and right sides of its lower surface 5, cavities 7 each corresponding to a split part for a quarter of each of second cam members 6 to be chilled which are located below the first cam members 3 and are laterally adjacent to each other.

Lateral surfaces 8 of the chill plate 1 are kept at minimum required gaps from lateral surfaces 8 of the adjacent chill plates 1 opposite thereto.

In the center of the chill plate 1, a hole 9 is formed to accept a fixed or floating shaft to be described later.

Figure 2:
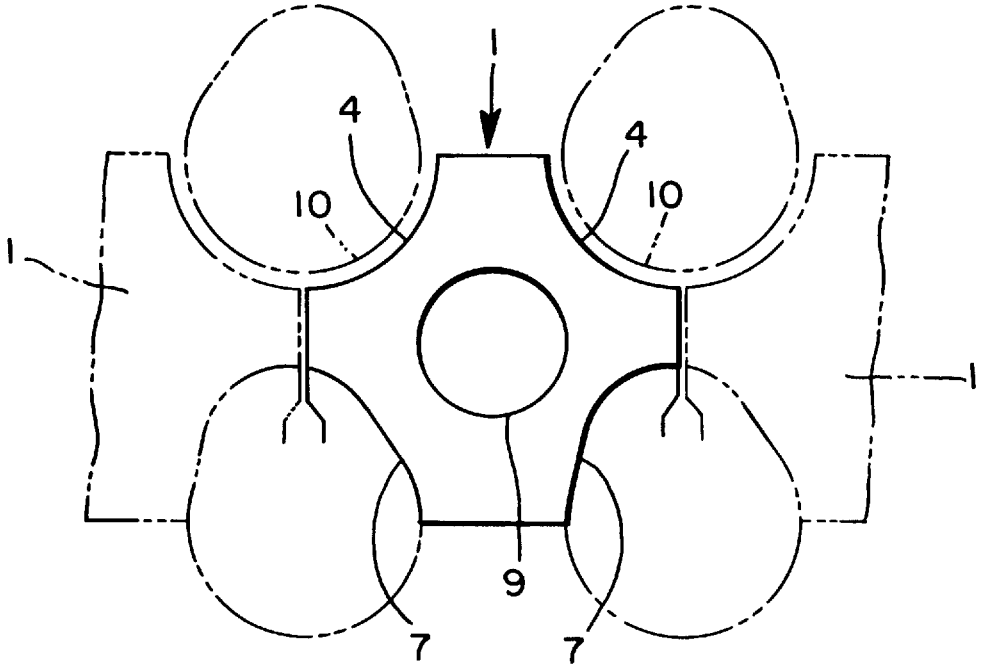
FIG. 2 is a front view of a chill plate according to another embodiment of the present invention wherein a part of profiles is not intended for chilling.

As apparent from the embodiment shown in FIG. 2, when some of the cavities 4 and 7 (in the embodiment shown in FIG. 2, the portions corresponding to the cavities 4 on the left and right sides of the upper surface) are to be formed as no-chilling portions, the cavities 4 may be formed as oversized profiles similar to corresponding portions 10 to provide gaps to be filled with foundry sand therebetween.

Figure 3:
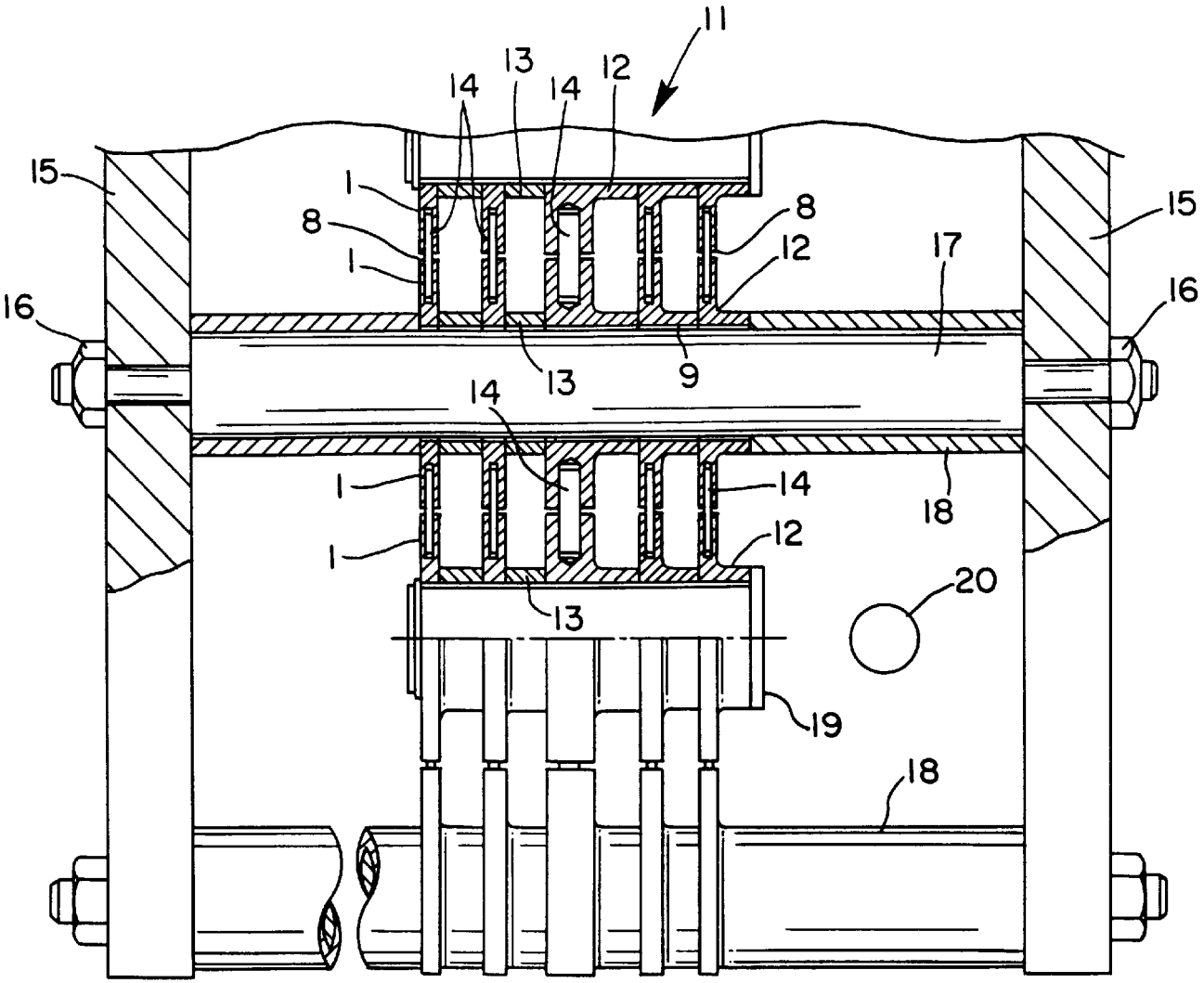
FIG. 3 is a partially cutaway front view of a chill plate cassette according to another embodiment of the present invention.
Figure 4:
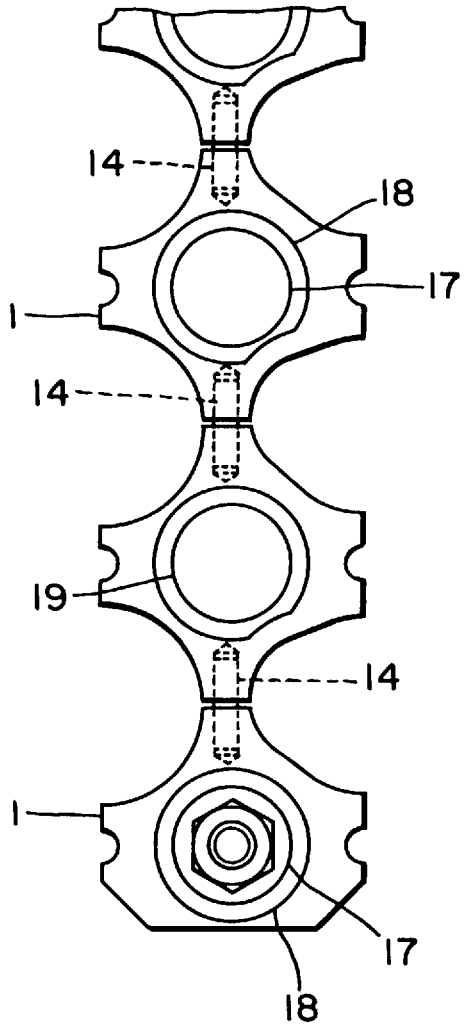
FIG. 4 is a side view of the embodiment in FIG. 3.

FIG. 3 shows a plan view of a mold 11 in which the chill plate 1 may have a boss 12 extending along the center hole 9, or a sleeve 13 may be interposed between the adjoining chill plates 1. Further, holes are formed on lateral surfaces 8 of the adjoining chill plates 1 to accept pins 14, and the chill plates 1 are connected to each other by inserting the pins 14 in the mating holes of both the chill plates 1 (see FIG. 4).

A description will now be made on the formation of the chill plates 1 into a cassette. Some chill plates 1 are secured to fixed shafts 17 secured to end plates 15 of the molds 11 with nuts 16 at both ends thereof with a predetermined interval maintained therebetween by collars or sleeves 13 and 18. The chill plates 1 and the fixing shafts 17 are fixed so that the chill plates 1 can freely move orthogonal to the fixed shafts 17 in a very small amount. The sleeves 13 and 18 prevent the chill plates 1 from moving in the axial direction of the fixed shafts 17.

Floating shafts 19 are disposed between the fixed shafts 17. Other chill plates 1 are supported by the floating shafts 19 at an interval defined by the bosses 12 or sleeves 13. The chill plates 1 supported by the floating shafts 19 are connected to the chill plates 1 supported by the fixed shafts 17 through the pins 14. As a result, the floating shafts 19 hang on the fixed shafts 17, with both ends thereof being free ends.

Figure 5:
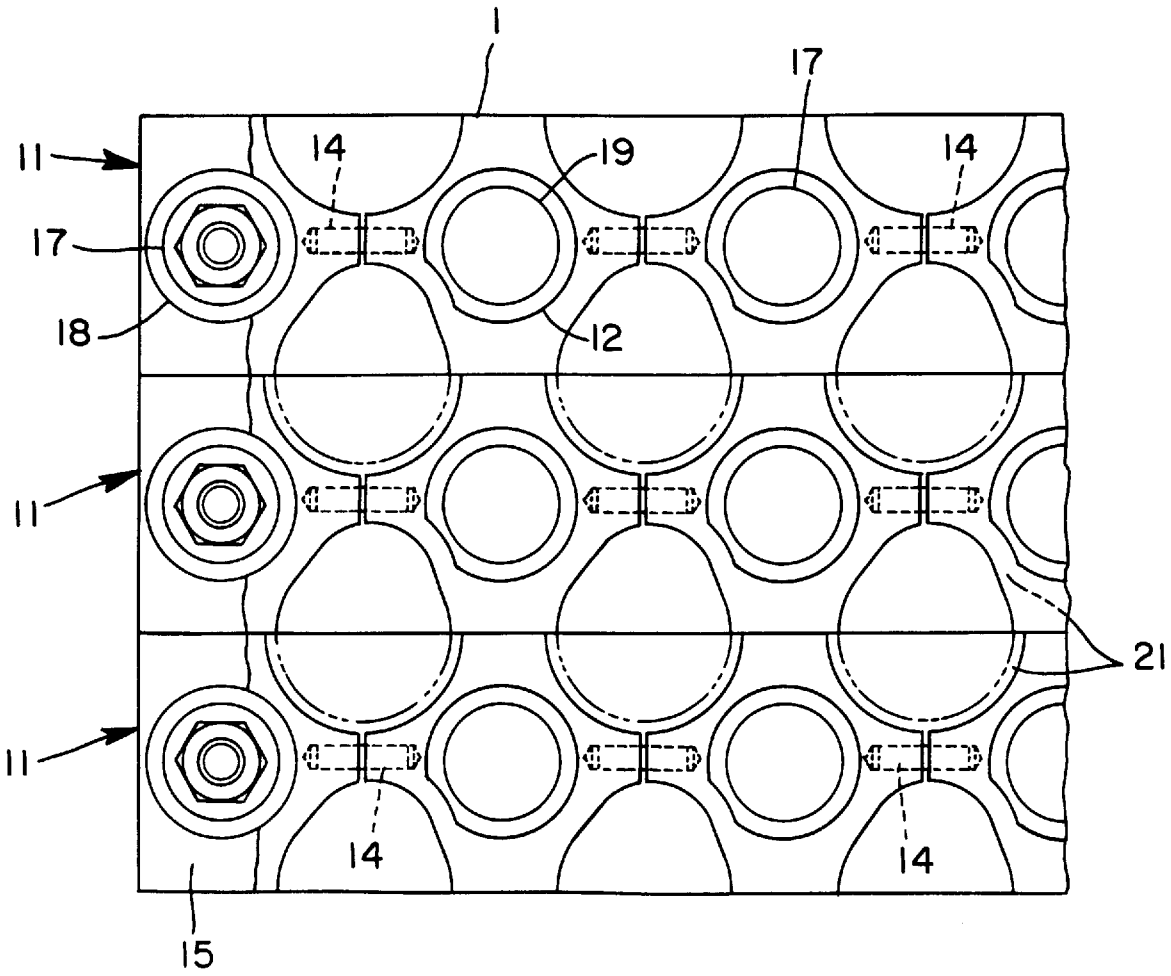
FIG. 5 is a sectional view of a stacked mold employing the chill plate cassette according to the embodiment of the present invention.

FIG. 5 shows the relationship between the chill plates 1 and between the shafts 17 and 19 in molds 11 which are vertically stacked.

As described above, in a configuration consisting of a plurality of lateral arrays of the cam shafts, a gating system 20 which is indispensable to casting is generally provided in a free space on a no-chilling shafts. Therefore, the floating shafts 19 supporting the chill plates 1 can not be secured to the end plates 15, and each of separate groups of the chill plates 1 is supported by the adjacent chill plates on both sides thereof which are put together by forcing the pins 14 into the holes in the center of the end faces of the left and right edges thereof.

FIG. 5 shows a mold utilizing the chill plate cassettes having a structure with chemically hardened molding sand 21 introduced therein. A plurality of cavities corresponding to shaft portions of the cam shafts are laterally arranged to be in parallel with each other in the longitudinal direction thereof, and the shape of one-half of the shaft portion is formed using the sand 21 on the upper and lower sides of each of the molds. The chill plates are disposed in predetermined positions so as to be orthogonal to the shaft portions. In this case, the chill plates for each of the cam shafts are integrated into the chill plate cassette which is disposed on a solid pattern for forming a chemically hardened mold. The upper and lower edges of the chill plates are aligned with parting surfaces of molds 11 to allow the cavities to be opened vertically.

The molds are stacked by simply matching the parting surfaces of the molds as shown in FIG. 5, which defines cam profiles and cavities corresponding to the shaft portions at the parting surfaces.

The present invention makes it possible to skip the steps of separating and arranging the individual chill plates and loading them into a magazine for mass production items. This allows the chill plates to be automatically installed and removed at a time and helps to improve an efficiency of a casting firm by providing a fully automated production line for partially chilled castings.

There is an additional advantage in that gaps for filling a foundry sand can become smaller to minimize the sand-metal ratio because the fixed shafts and the integrated chill plates having collars or bosses that constitute a chill plate cassette according to the invention are positioned in the middle of each section of the plurality of molds and because the outline of the collars or bosses may be configured freely to some extent.

Since the chill plate cassette according to the present invention has a rigid framework provided by a plurality of fixed shafts and end plates and is configured as a mold having a rigid structure itself. Therefore, the mold itself is protected from deformation. Further, each individual chill plate is formed in a cross-like configuration which suppresses deformation of itself. The chill plate cassette obtained by connecting a plurality of lateral arrays of such chill plates has a mechanism which allows individual chill plates to move in a very small amount. This allows the cassette to be accurately and faithfully fitted to a solid pattern of a metal mold during molding and improves the dimensional accuracy of castings significantly.

In the chill plate according to the present invention, a no-chilling portion can be easily provided. Applications of this feature include cam shafts in which only cam noses must be hardened by chilling and adjoining shaft portions in staggered stack-casting.

While specific illustrated embodiments have been shown and described, it will be obvious to those skilled in the art that various changes and modifications may be made to the invention without departing from the spirit and scope of the invention as set forth in the appended claims.

What is claimed is:

1. A chill plate, comprising:

a plurality of outer side surfaces;

a plurality of cavities, each cavity disposed on a periphery of said chill plate between adjacent outer side surfaces of said plurality of outer side surfaces, and each said cavity having a shape which corresponds to a shape of a part to be chilled; and a through hole disposed substantially in a center of said chill plate, said through hole for receiving a shaft therein.

2. A chill plate according to claim 1, further comprising:

a hole disposed in each of left and right sides of said plurality of sides for receiving a connecting pin therein.

3. A chill plate according to claim 1, wherein at least one of said cavities has an oversized profile to form a no-chilled portion.

4. A chill plate according to claim 1, having four outer side surfaces.

5. A chill plate according to claim 4 comprising four cavities, wherein each of said four cavities is disposed on a periphery of said chill plate between adjacent outer side surfaces.

6. A chill plate according to claim 5, wherein each of said cavities comprises a concave surface connecting two adjacent outer side surfaces.

7. A chill plate cassette comprising:

a plurality of chill plate layers, wherein each layer comprises a plurality of chill plates coupled in a first lateral direction, and wherein said chill plates are supported along a second lateral direction by a plurality of fixed and floating shafts disposed in through holes disposed substantially in a center of each of said chill plates;

a vertical stack of said chill plate layers; and a plurality of left and right end plates each comprising a plurality of through holes for receiving and fastening left and right end portions of said fixed shafts, respectively, to said plates.

8. A chill plate cassette according to claim 7 wherein each of said chill plates comprises:

a plurality of outer side surfaces;

a plurality of cavities, each disposed on a periphery of said chill plate between adjacent outer side surfaces of said plurality of outer side surfaces, and each said cavity having a shape which corresponds to a shape of a part to be chilled; and a through hole disposed substantially in a center of said chill plate, said through hole for receiving a shaft therein.

9. A chill plate cassette according to claim 7 further comprising a plurality of pins for coupling said plurality of chill plates in said first lateral direction, wherein said plurality of pins are received by holes disposed in left and right sides of said chill plates.

10. A chill plate cassette according to claim 7 further comprising:

a plurality of bosses disposed between adjacent chill plates in said second lateral direction for properly spacing said chill plates.

11. A chill plate cassette according to claim 7 further comprising:

a first collar disposed concentrically on each fixed shaft between each of said left end plates and a chill plate closest, in said second lateral direction, to said left end plate; and a second collar disposed concentrically on each fixed shaft between each of said right end plates and a chill plate closest, in said second lateral direction, to said right end plate.

12. A stacked mold comprising:

a plurality of vertically stacked left and right end plates;

a plurality of horizontal fixed shafts supported by each pair of said left and right end plates, wherein said plurality of horizontal fixed shafts is spaced along a lengthwise direction of said end plates;

a plurality of first chill plates arranged along each of said fixed shafts;

a plurality of second chill plates interposed between each of said first chill plates along said lengthwise direction; and a plurality of horizontal floating shafts, disposed parallel to said horizontal fixed shafts, and supported by said plurality of second chill plates.

13. A stacked mold according to claim 12 wherein said first and second chill plates each comprise:

a plurality of outer side surfaces;

a plurality of cavities, each disposed on a periphery of said chill plate between adjacent outer side surfaces of said plurality of outer side surfaces, and each said cavity having a shape which corresponds to a shape of a part to be chilled; and a through hole disposed substantially in a center of said chill plate, said through hole for receiving a shaft therein.

14. A stacked mold according to claim 12 further comprising connecting pins coupling said first and second chill plates in said lengthwise direction.

15. A stacked mold according to claim 12 further comprising a plurality of bosses disposed between adjacent first chill plates and between adjacent second chill plates in a direction parallel to said horizontal fixed and floating shafts, said plurality of bosses properly spacing said first and second chill plates.

16. A stacked mold according to claim 12 further comprising:

a first collar disposed concentrically on each fixed shaft between each of said left end plates and a chill plate of said plurality of first and second chill plates closest, in said second lateral direction, to said left end plate; and a second collar disposed concentrically on each fixed shaft between each of said right end plates and a chill plate of said plurality of first and second chill plates closest, in said second lateral direction, to said right end plate.

* * * * *